US008182615B2

(12) United States Patent
Classen et al.

(10) Patent No.: US 8,182,615 B2
(45) Date of Patent: May 22, 2012

(54) DOSING DEVICE FOR THE ADDITION OF AN ADDITIVE TO A TREATMENT CHAMBER AND DISHWASHER MACHINE WITH A DOSING DEVICE

(75) Inventors: Egbert Classen, Wertingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1316 days.

(21) Appl. No.: 11/640,506

(22) Filed: Dec. 15, 2006

(65) Prior Publication Data

US 2007/0193609 A1 Aug. 23, 2007

(30) Foreign Application Priority Data

Dec. 27, 2005 (DE) ..... 10 2005 062 479

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS

| | | | | |
|---|---|---|---|---|
| 3,556,691 | A * | 1/1971 | Burt | 417/500 |
| 6,545,384 | B1 | 4/2003 | Pelrine et al. | |
| 2002/0117187 | A1 * | 8/2002 | Helminger | 134/18 |
| 2002/0185937 | A1 | 12/2002 | Heim et al. | |
| 2003/0214199 | A1 | 11/2003 | Heim et al. | |
| 2003/0218403 | A1 | 11/2003 | Dubowsky et al. | |
| 2004/0008853 | A1 | 1/2004 | Pelrine et al. | |
| 2007/0144558 | A1 * | 6/2007 | Classen et al. | 134/18 |

FOREIGN PATENT DOCUMENTS

WO WO 2005/058126 6/2005

OTHER PUBLICATIONS

Classen et al., WO 2005/058126, Jun. 2005, English machine translation.*

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A dosing device for the addition of an additive to a treatment chamber (8) is described, wherein the additive can be added to the treatment chamber (8) by means of a conveying device (5, 6, 7), characterized in that the dosing device (1) has at least one actuator (9, 10, 11) which has at least one transmission means each having two electrodes and a polymer electrically operatively connected thereto, in which a first section of the polymer can be deflected depending on an electric field generated by the two electrodes.

34 Claims, 1 Drawing Sheet

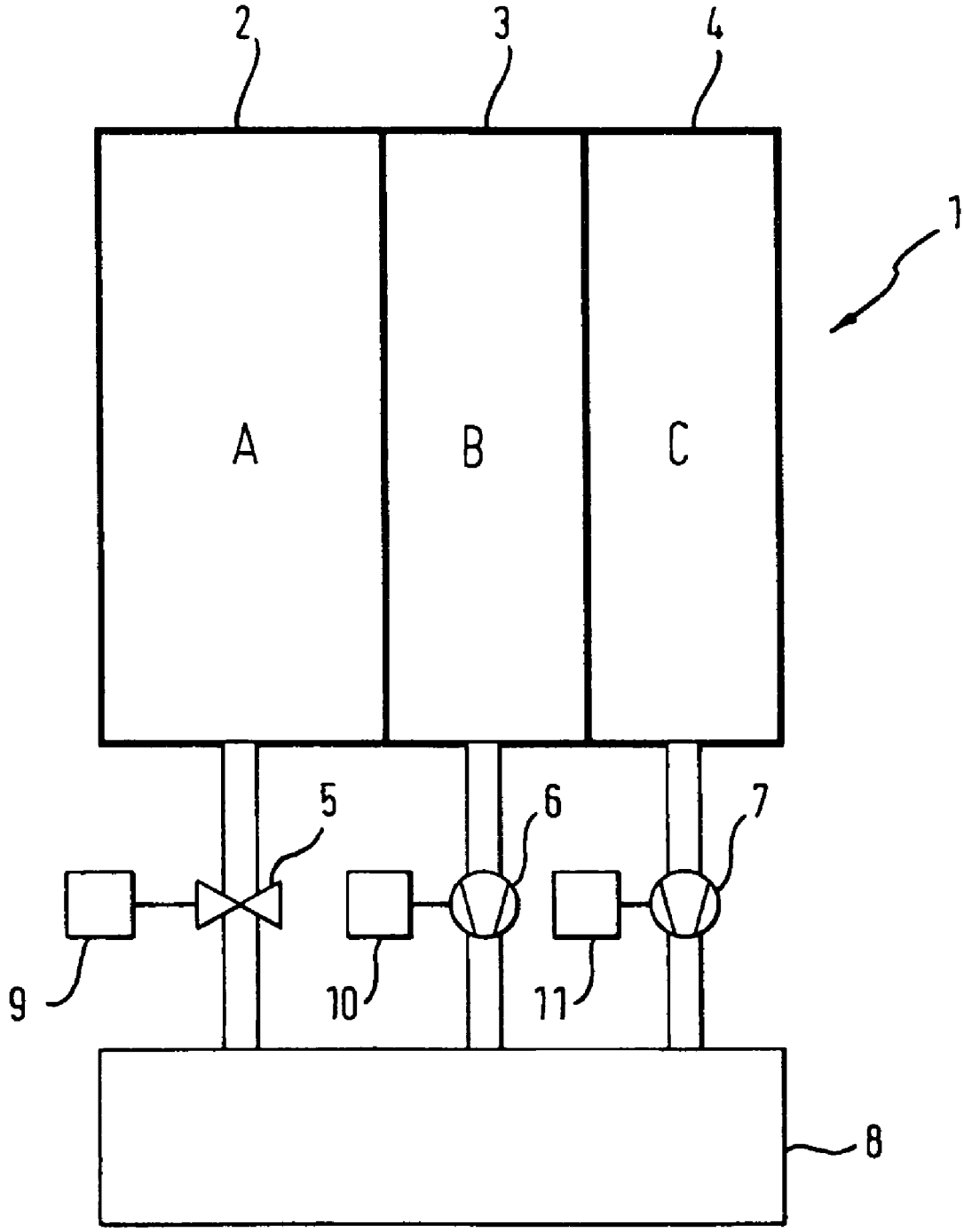
2
3
4
1
A
B
C
5
6
7
9
10
11
8

DOSING DEVICE FOR THE ADDITION OF AN ADDITIVE TO A TREATMENT CHAMBER AND DISHWASHER MACHINE WITH A DOSING DEVICE

BACKGROUND OF THE INVENTION

The invention relates to a dosing device for the addition of an additive to a treatment chamber, in particular for a water-carrying household appliance, wherein the additive can be added to the treatment chamber by means of a conveying device driven by at least one actuator. The invention further relates to a dishwasher machine provided with a dosing device of this type.

Additives are required for all process or program steps, in particular for the "cleaning" process step in dishwasher machines, these additives comprising, for example, cleansing agents, washing agents, care agents, decalcifiers and rinse agents as well as supplementary additives such as active chlorine or bleach. The additives are generally supplied as solids in the form of free-flowing powders, powders compressed into tabs, as gels or as liquids. The amounts of additives required in each case must usually be added manually by the user before the beginning of each cleaning cycle, apart from rinse agents, for example, the proportions of the individual agents being fixedly preset with regard to the actual requirement. Only the rinse agent is stored in highly diluted form in storage containers for several applications and automatically added via a dosing device provided that no combination product with integrated rinse agent fraction is used.

The additives for dishwasher machines used in the prior art, in particular cleansing agents, consist of a mixture of different substances or basic chemicals with different, in each case very special tasks. The additives used so far, whether these be supplied manually or automatically, are "all-round products" or "combination products" which are designed for a very broad spectrum of applications. A specific selection of the different substances or basic chemicals required for a particular application or process step, e.g. for the "cleaning" program step, is therefore not possible because so much additive would need to be added until the portion of the substance or basic chemical required for every conceivable common domestic application is reached.

For example, cleansing agents used is the prior art as compact cleansers for dishwasher machines consist of the following basic chemicals as additives: non-ionic tensides (wetting agents), phosphates (builders), soda and silicates (alkali carriers), perborate and TAED (bleaching agents), amylase and protease (enzymes) as well as anti-foam agents, softeners, fragrances, dyes, disintegrants and coatings/binders (adjuvants not directly involved in the cleansing process). For the removal of vegetable fat, for example, from dishes in the "cleaning" program step in a dishwasher machine, however, only builders and alkali carriers are required. All the other components are disadvantageously not required in this program step, i.e. they are added without actually being necessary.

As a rule, therefore, a disadvantageous quantitative overdosing is required both during manual and automatic addition of the "all-round product", e.g. as an all-round cleaner in order to ensure the minimum quantity of the required fraction of the basic chemicals required for the specific application. Other basic chemicals of the additive are, for example, little involved or not all involved in the cleaning process. These disadvantageously pollute the environment to a considerable extent due to the large number of dishwasher machines and their frequent use. Furthermore, high costs are thereby incurred for the user of dishwasher machines for the acquisition of basic chemicals in the additives which are used unnecessarily.

In general, liquid rinse agents are generally used in dishwasher machines which, as a result of the required dosing accuracy, consist of about 97 vol. % water and only 3 vol. % is effectively active as rinse agent in order to achieve a higher dosing accuracy because harmful excess foaming of the dishwasher occurs in the event of overdosing.

In order that only the basic chemicals needed for the respective requirement, in particular basic chemicals of all-round products, need to the added to the washing container in dishwasher machines, a dishwasher machine with a dosing device for adding additives to the washing container is proposed in DE 103 58 969.4 of the applicant in which at least one basic chemical used for clear rinsing and/or at least two basic chemicals together but not all the basic chemicals of an all-round product together and/or at least one reaction mixture of basic chemicals can be added independently. The basic chemicals are added by means of a conveying device, in particular a micro-dosing pump, e.g. a flexible tube or gear pump to a micro-reactor to produce the reaction mixture by a chemical reaction and/or to the washing container. The addition parameters, time and quantity of basic chemicals for a process step are regulated depending on the program steps and/or the actual contamination which is detected automatically with sensors or manually. The components or basic chemicals can thus be optimally dosed because a specific dosage according to time and quantity is possible. The basic chemicals are added at the optimal time point within the process step in each case and the optimal quantity is also added in each case. The basic chemicals are stored in refillable or exchangeable storage containers which are preferably constructed in the form of a common housing with partition walls or in individual separate units.

The additives described in the prior art require an actuator in the dosing device as a drive for the conveying device. In the prior art, these actuators are, for example, electric motors or other drive members which are expensive and require maintenance. A large number of actuators is normally required to add a large number of different additives to the added separately so that the disadvantage of the actuators known from the prior art is thereby amplified.

BRIEF SUMMARY OF THE INVENTION

The object of the present invention is to provide a dosing device for the addition of an additive to a treatment chamber as well as a dishwasher machine with such a dosing device which allows the dosing device to be driven as simply as possible.

These objects are achieved by a dosing device according to the invention having the features of claim 1 and a dishwasher machine according to the invention having the features of claim 11. Advantageous further developments of the invention are characterized by the dependent claims.

In a dosing device for the addition of an additive to a treatment chamber, in particular for a water-carrying household appliance, wherein the additive can be added to the treatment chamber by means of a conveying device driven by at least one actuator, wherein the at least one actuator is embodied as an electroactive polymer for driving the conveying device. The electroactive polymer can be deflected by applying an electric current or an electric field. This deflection or change in volume of the electroactive polymer is used for mechanical driving of the conveying device. Optionally, mechanical transmission means, e.g. gears or levers are required for this purpose. As a result, other more expensive actuators requiring more maintenance, e.g. electric motors, hydraulic or pneumatic drives, can be dispensed with.

Preferably at least one actuator comprises a first section with a mechanical transmission means for driving the conveying device each having two electrodes and a polymer electrically operatively connected thereto, in which the first section of the polymer can be deflected depending on an electric field generated by the two electrodes.

Depending on which deflection of the first section of the polymer is required, it can be provided that a plurality of transmission means each having two electrodes and a polymer electrically operatively connected to these electrodes is provided. Electroactive polymers can be produced in almost any form on account of the free design of the polymer. In this case, they can completely dispense with components to be driven mechanically such as a motor, for example. Driving is effected merely by the voltage being applied to two electrodes. Electroactive polymers also have the advantage that they have a fast response capability when a corresponding voltage is applied. Electroactive polymers are designed in such a manner, for example that the deflection can be produced in the form of a lateral lengthening or shortening or also in a bending.

In order to intensify the deflection as well as to increase the force generated by the polymer, a second section of the polymer can be provided with a support means which supports the conversion of electrical energy into mechanical energy of the polymer. The support means can be any frame connected to the polymer or a spring or the like.

The use of an electroactive polymer as an actuator allows a particularly simple configuration of the dosing device. In addition to a high energy efficiency, extremely accurate dosing of the additive can also be made.

The at least one actuator of the conveying device is preferably assigned to the dosing device. The dosing device can be constructed, for example, as described in DE 103 58 969.4 whose content is included by reference in the present application.

In one embodiment, the conveying device is embodied as a reciprocating and rotary pump, in particular as a micro-membrane pump or a piston pump, with a pump chamber or metering valve and the actuator can be actuated to change the volume of the pump chamber.

In another embodiment, the conveying device is designed to control a flow of the additive present as a fluid, wherein the device has a surface in contact with the fluid, which surface is in operative connection with at least one of the transmission means, wherein a change in the flow rate of the additive can be brought about by a deflection of the polymer. In this embodiment, the actuator has the form of a valve which can be opened and closed by driving. The additive can be added to the treatment chamber, for example using gravity or in combination with a device which exerts pressure on the additive, which can be actuated, for example, using a further electroactive polymer.

In a further embodiment, the conveying device is embodied as a micro-dosing pump, wherein the at least one actuator is used to produce a rotational movement for a conveying means to be driven. The conveying means to be driven can, for example, be an impeller. A plurality of actuators synchronised with respect to one another which can drive a shaft by synchronised execution of a linear movement is required to produce a rotational movement.

Whereas in one embodiment of the dosing device according to the invention, the treatment chamber is a washing container of a dishwasher machine, according to another embodiment this is a micro-reactor in which a reaction mixture can be produced by adding a plurality of different additives whilst a chemical reaction takes place and this reaction mixture for its part can be added, for example, to the washing container of a dishwasher machine.

In a further embodiment, the dosing device according to the invention has a plurality of conveying devices for adding respectively one basic chemical to the treatment chamber, wherein each of the conveying devices each has at least one actuator. By this means, it is possible to meter different basic chemicals into the treatment chamber according to the requirements.

In a water-carrying household appliance according to the invention, in particular a dishwasher machine, provided with a dosing device for addition of at least one basic chemical to the treatment chamber, in particular washing container, the dosing device has at least one actuator which comprises at least one transmission means each with two electrodes and a polymer electrically operatively connected to said electrodes, in which a first section of the polymer can be deflected depending on an electric field generated by the two electrodes. In preferred embodiments of the dishwasher machine according to the invention, the dosing device is embodied as described previously.

In a further embodiment, the at least one basic chemical is stored in a refillable or exchangeable storage container which is preferably embodied in the form of a common housing with partition walls or in individual separate units.

BRIEF DESCRIPTION OF THE DRAWINGS

The invention will now be explained in greater detail with reference to an arrangement for executing the method of the present invention illustrated in the sole FIGURES of the drawings, in which the sole FIGURE of the drawings is a front elevational view of a dosing device in accordance with the present invention for use in a residential dishwashing machine.

The present invention is explained in detail with reference to an exemplary embodiment. The single FIGURE shows a schematic view of a dosing device 1 according to the invention which is preferably used in a domestic dishwasher machine.

DETAILED DESCRIPTION OF THE INVENTION

The additives, e.g. cleansing and rinse agents, for the dishwasher machine are not accommodated as a combination product in respectively one storage container but the individual basic chemicals A, B, C are accommodated separately in storage containers 2, 3, 4. A combination product could also be stored in one storage container, for example.

The storage containers 2, 3, 4 can be designed in the form of a common housing with partitions, e.g. in the form of partition walls, with or without a respective integrated conveying device 5, 6, 7. Alternatively, separate, individual storage containers 2, 3, 4 can be formed, which can each be provided with or without the respective conveying device 5, 6, 7. Furthermore, a combination of both these embodiments is also feasible.

The basic chemicals A, B, C can either be refilled in the storage containers 2, 3, 4 or the storage containers 2, 3, 4 are exchangeable and can be replaced by full storage containers 2, 3, 4 after emptying. In the case of exchangeable storage containers 2, 3, 4, the fixing of storage containers 2, 3, 4 in the incorrect location can be eliminated by applying a readable code or by means of different mechanical plug-in devices (not shown) for each individual storage container 2, 3, 4. In addition, the user can be guided to insert the storage containers 2, 3, 4 in the correct location by means of corresponding signal devices, e.g. colors or symbols on the storage containers 2, 3, 4 and on the location (not shown). The size of the storage containers 2, 3, 4 can be selected according to the presumed quantitative requirement for the components A, B, C.

The basic chemicals A, B, C, e.g. in the form of concentrates, are preferably a liquid but can also be a gel or a powder or granular solid. Additives which are not broken down into components e.g. rinse agents, can also be stored in the storage containers 2, 3, 4.

The components A, B, C are supplied to the treatment chamber 8 in a precisely dosed manner by means of the conveying device 5, 6, 7. The treatment chamber 8 can be formed by a washing container or a micro-reactor located upstream of a washing container. The design of a micro-reactor is determined according to process parameters, e.g. reaction control and reaction quantities of basic chemicals A, B, C to be mixed with one another. The ratio between surface and volume in the reaction vessels can be used for rapid and safe process control even with reactive mixtures. The micro-reactor can, for example, contain micro-mixers, heat exchangers, sensors for pressure and analysis and catalysts, in particular as a coating on the inner surface of the reaction vessel. A plurality of micro-reactors can also be connected in series or in a row with corresponding supply lines as lines from the storage containers 2, 3, 4 (not shown). In a micro-reactor the basic chemicals A, B, C react to form a reaction mixture which is supplied to the cleaning process in the washing container of the dishwasher machine.

The basic chemicals A, B, C are metered by means of the conveying devices 5, 6, 7. These can be embodied in the form of a valve (reference numeral 5) or a reciprocating and rotary pump (reference numeral 6) or a micro-metering pump (reference numeral 7). An actuator 9, 10, 11 is assigned to each of the conveying devices 5, 6, 7. The actuator 9, 10, 11 has at least one transmission means each having two electrodes and a polymer electrically operatively connected thereto, in which a first section of the polymer can be deflected depending on an electric field generated by the two electrodes. In other words, the actuator converts electrical energy into mechanical energy. To support the conversion of electrical energy into mechanical energy, a second section of the polymer can be provided with a support means, e.g. in the form of a spring or a force-guiding frame.

Transmission means of this type are known from the prior art and are designated there as an electroactive polymer, dielectric elastomer, electro-elastomer or EPAM. The fundamental structure and operating mode of such a transmission means are described, for example, in U.S. Pat. No. 6,545,384 B1. Actuators for providing a rotational movement, such as is required to operate a micro-metering pump can be deduced, for example, from US 2002/0185937 A1. An actuator acting as a valve is disclosed in US 2003/0214199 A1. A plurality of exemplary embodiments as to the manner in which electroactive polymers can be configured and how they can be used for dosing an additive in the conveying device within the scope of the present invention can be deduced from US 2003/0218403 A1. Finally, US 2004/0008853 A1 discloses a device for performing thermodynamic work on a fluid using one or more electroactive polymer transducers with an electroactive polymer which deflects in response to the application of an electric field. The exemplary embodiments specified in this document can be used, for example, for the operation of a pump, e.g. a micro-metering pump.

The dosing device according to the invention can be used to provide dosing devices with a simple mechanical structure by using electroactive polymers as actuators. In this case, the addition of an additive to a treatment chamber can be dosed highly accurately using only a small quantity of energy.

Reference List

1 Dosing device
2 Storage container
3 Storage container
4 Storage container
5 Conveying device
6 Conveying device
7 Conveying device
8 Treatment chamber
9 Actuator
10 Actuator
11 Actuator
A, B, C Basic chemicals

The invention claimed is:

1. A dosing device for the addition of an additive to a treatment chamber for a water-carrying household appliance, the device comprising: a conveying device driven by an actuator adding the additive to the treatment chamber, the actuator including an electroactive polymer driving the conveying device, wherein the conveying device includes a reciprocating pump having a pump chamber and the actuator being actuated to change the volume of the pump chamber.

2. The device according to claim 1, wherein the actuator comprises a mechanical transmission means for driving the conveying device and having two electrodes electrically operatively connected to the polymer, the polymer including a first section being deflectable in response to an electric field generated by the two electrodes to convert electrical energy into mechanical energy.

3. The device according to claim 2, wherein the polymer includes a second section having a support means supporting the conversion of electrical energy into mechanical energy of the polymer and including at least one of a spring and a force-guiding frame.

4. The device according to claim 2, wherein the actuator of the conveying device is assigned to the dosing device.

5. The device according to claim 1, wherein the reciprocating pump includes at least one of a micro-membrane pump and a piston pump.

6. The device according to claim 2, wherein the conveying device controls a flow of the additive present as a fluid, wherein the conveying device has a surface in contact with the fluid, which surface is in operative connection with the transmission means, wherein a change in the flow rate of the additive can be brought about by a deflection of the polymer.

7. The device according to claim 1, wherein the treatment chamber includes a washing container of a dishwasher machine.

8. The device according to claim 1, wherein the treatment chamber includes a micro-reactor in which a reaction mixture can be produced by adding a plurality of different additives while a chemical reaction takes place.

9. The device according to claim 1, wherein said device has a plurality of conveying devices for adding respectively one basic chemical to the treatment chamber, wherein each of the conveying devices includes a corresponding actuator.

10. The device according to claim 9, wherein the plurality of conveying devices includes a micro-dosing pump and the actuator is used to produce a rotational movement driving a conveying means.

11. A dosing device for the addition of an additive to a treatment chamber for a water-carrying household appliance, the device comprising: a conveying device driven by an actuator adding the additive to the treatment chamber, the actuator including an electroactive polymer driving the conveying device, wherein the conveying device includes a metering valve.

12. The device according to claim 11, wherein the actuator comprises a mechanical transmission means for driving the conveying device and having two electrodes electrically operatively connected to the polymer, the polymer including a first section being deflectable in response to an electric field generated by the two electrodes to convert electrical energy into mechanical energy.

13. The device according to claim 12, wherein the polymer includes a second section having a support means supporting the conversion of electrical energy into mechanical energy of the polymer and including at least one of a spring and a force-guiding frame.

14. The device according to claim 12, wherein the actuator of the conveying device is assigned to the dosing device.

15. The device according to claim 12, wherein the conveying device controls a flow of the additive present as a fluid, wherein the conveying device has a surface in contact with the fluid, which surface is in operative connection with the transmission means, wherein a change in the flow rate of the additive can be brought about by a deflection of the polymer.

16. The device according to claim 11, wherein the treatment chamber includes a washing container of a dishwasher machine.

17. The device according to claim 11, wherein the treatment chamber includes a micro-reactor in which a reaction mixture can be produced by adding a plurality of different additives while a chemical reaction takes place.

18. The device according to claim 11, wherein said device has a plurality of conveying devices for adding respectively one basic chemical to the treatment chamber, wherein each of the conveying devices includes a corresponding actuator.

19. The device according to claim 18, wherein said plurality of conveying devices includes a micro-dosing pump and the actuator is used to produce a rotational movement driving a conveying means.

20. The device according to claim 18, wherein said plurality of conveying devices includes a reciprocating pump having a pump chamber and the actuator being actuated to change the volume of the pump chamber.

21. The device according to claim 20, wherein the reciprocating pump includes at least one of a micro-membrane pump and a piston pump.

22. The device according to claim 9, wherein the plurality of conveying devices includes a metering valve.

23. A dishwasher comprising: a treatment chamber; a dosing device for addition of an additive to the treatment chamber and comprising a conveying device; and an actuator driving the conveying device and adding the additive to the treatment chamber, the actuator including an electroactive polymer driving the conveying device, wherein the conveying device includes a metering valve.

24. The dishwasher according to claim 23, wherein the treatment chamber includes a micro-reactor in which a reaction mixture can be produced by adding a plurality of different additives while a chemical reaction takes place.

25. The dishwasher according to claim 23, wherein said device has a plurality of conveying devices for adding respectively one basic chemical to the treatment chamber, wherein each of the conveying devices includes a corresponding actuator.

26. The dishwasher according to claim 23, wherein the additive includes at least one basic chemical that can be supplied to the washing container.

27. The dishwasher according to claim 26, wherein the at least one basic chemical is stored in a storage container which is embodied in the form of a common housing with at least one of partition walls and individual separate units, the storage container being at least one of refillable and exchangeable.

28. The dishwasher according to claim 23, wherein the actuator comprises a mechanical transmission means for driving the conveying device and having two electrodes electrically operatively connected to the polymer, the polymer including a first section being deflectable in response to an electric field generated by the two electrodes to convert electrical energy into mechanical energy.

29. The dishwasher according to claim 28, wherein the polymer includes a second section having a support means supporting the conversion of electrical energy into mechanical energy of the polymer and including at least one of a spring and a force-guiding frame.

30. The dishwasher according to claim 28, wherein the actuator of the conveying device is assigned to the dosing device.

31. The dishwasher according to claim 25, wherein the plurality of conveying devices includes a reciprocating pump having a pump chamber and the actuator being actuated to change the volume of the pump chamber.

32. The dishwasher according to claim 31, wherein the reciprocating pump includes at least one of a micro-membrane pump and a piston pump.

33. The dishwasher according to claim 28, wherein the conveying device controls a flow of the additive present as a fluid, wherein the device has a surface in contact with the fluid, which surface is in operative connection with the transmission means, wherein a change in the flow rate of the additive can be brought about by a deflection of the polymer.

34. The dishwasher according to claim 25, wherein the plurality of conveying devices includes a micro-dosing pump and the actuator is used to produce a rotational movement driving a conveying means.

* * * * *